United States Patent [19]

Branchaud

[11] 4,008,828

[45] Feb. 22, 1977

[54] NEWSPAPER VENDING MACHINE

[76] Inventor: Jean-Marie Branchaud, 3655 Papineau St., Apt. 403, Montreal, Quebec, Canada

[22] Filed: Sept. 29, 1975

[21] Appl. No.: 617,535

[52] U.S. Cl. ..... 221/241; 221/251; 221/279; 221/298

[51] Int. Cl.[2] ..... B65H 1/02

[58] Field of Search ..... 221/155, 213–216, 221/241, 251, 279, 298, 273, 274, 226

[56] References Cited

UNITED STATES PATENTS

| | | | |
|---|---|---|---|
| 2,255,538 | 9/1941 | Cameron | 221/251 X |
| 3,104,781 | 9/1963 | Clift | 221/273 X |
| 3,536,231 | 10/1970 | Knickerbocker | 221/251 X |
| 3,749,281 | 7/1973 | Stovers et al. | 221/279 X |

*Primary Examiner*—Robert B. Reeves
*Assistant Examiner*—Francis J. Bartuska

[57] ABSTRACT

A coin-operated newspaper vending and dispensing machine adapted for low cost and maintenance, reliable dispensing of one newspaper at a time and accurate and quick setting for dispensing newspapers of any one of a plurality of thicknesses to suit the particular thickness of the current edition. A newspaper vending machine comprising a handle fixed to actuating rods extending lengthwise of the stack in engagement with cam levers arranged to upwardly wedge a blade between the first newspaper, at one end of the stack and the remainder of the latter, an adjustable pivotally settable onto a carriage about an axis extending transversely of the stack, a newspaper delivering plate movably engageable with that one end of the stack, a pair of rods coupling the adjustable lever to the newspaper delivering plate to adjust the latter lengthwise of the stack and thence vary the spacing between the newspaper delivering plate and the blade, and projections on the actuating rods adapted to engage the carriage and jointly displace the latter and the plate to release that one newspaper for access thereto.

9 Claims, 20 Drawing Figures

NEWSPAPER VENDING MACHINE

A vending machine and, more particularly, a newspaper vending machine of the type which is coin-operated.

Numerous embodiments of newspaper vending and dispensing machines of the above type have been proposed so far wherein a stack of newspapers is inserted to be delivered or dispensed one at a time. However, the machines which have been produced so far are not considered completely satisfactory. The following disadvantages or inconveniences are found either singly or in combination into the heretofore proposed machines of the above type. The design is relatively complex and costly; the machine includes parts or mechanisms which require substantial maintenance; the machine is not adjustable for newspapers of different thicknesses or, if so adjustable, the adjustment device is not adapted for quick and accurate setting.

It is the general object of the invention to provide a newspaper vending machine of the above type which is substantially devoid of the above-mentioned disadvantages and inconveniences.

It is another object of the invention to provide a newspaper vending machine of the above type, which is free of gearing, ratchet and the like rotary elements, which includes simple and inexpensive parts and which is manually operated to minimize the cost, complexity and maintenance thereof.

It is a further object of the invention to provide a newspaper vending machine of the above type which is provided with a simple but nevertheless accurate and readily settable adjustment device for reliably dispensing newspapers of different thicknesses one at a time and such as to suit the thickness of any current edition of the newspaper.

The invention will now be described in detail with reference to a preferred embodiment thereof, which is illustrated, by way of example only, in the accompanying drawings, in which.

Figure 1:
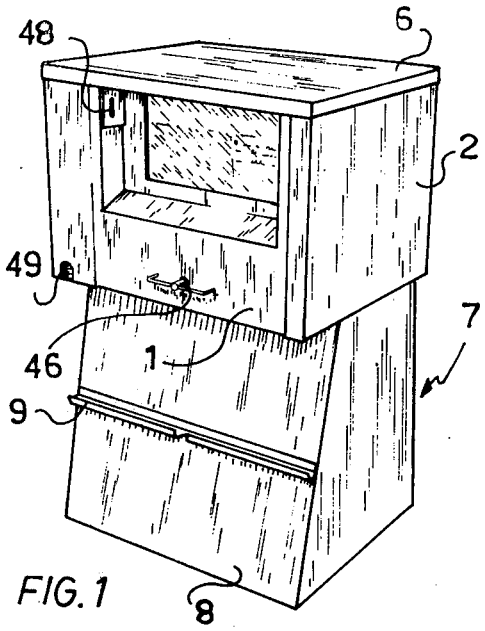
FIG. 1 is a perspective view of a newspaper vending machine according to the invention.
Figure 2:
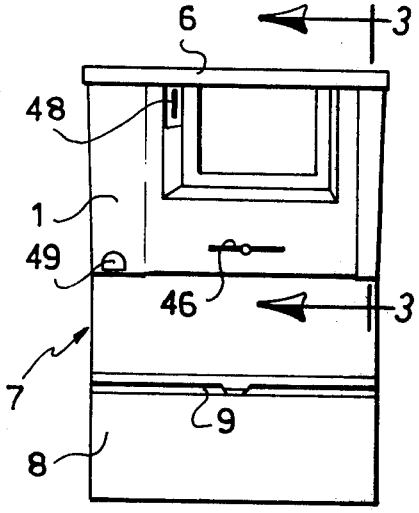
FIG. 2 is a front view of the newspaper vending machine.
Figure 3A:
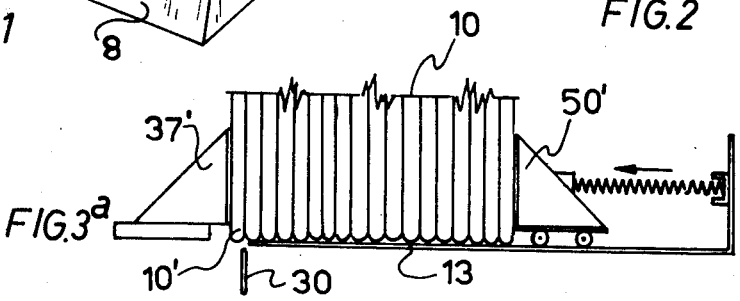
FIG. 3 is a cross-sectional view as seen along line 3—3 in FIG. 2.
Figure 3B:
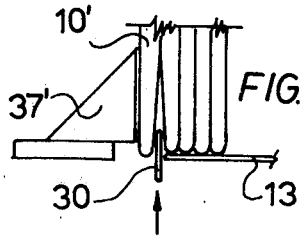
Figure 3C:
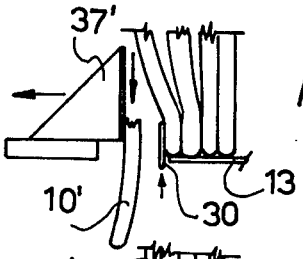
Figure 3D:
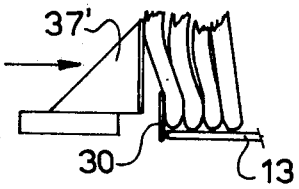
Figure 3E:
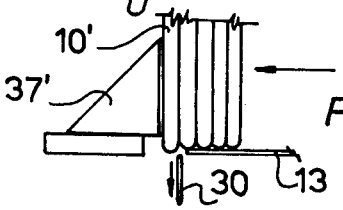
Figures 3, 4, 5, 6:
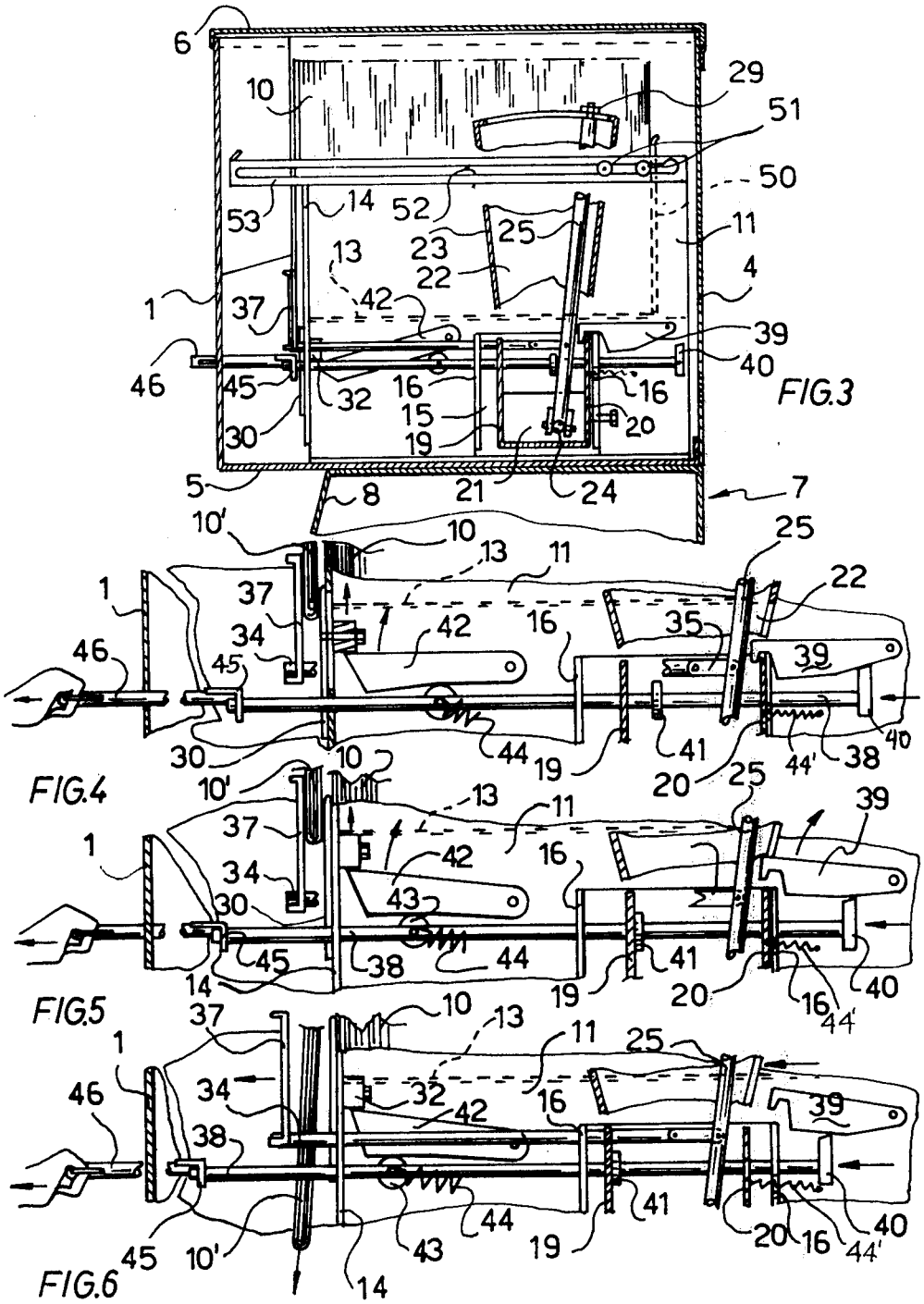
Figures 7, 8, 9, 10, 11, 12, 13, 14, 15:
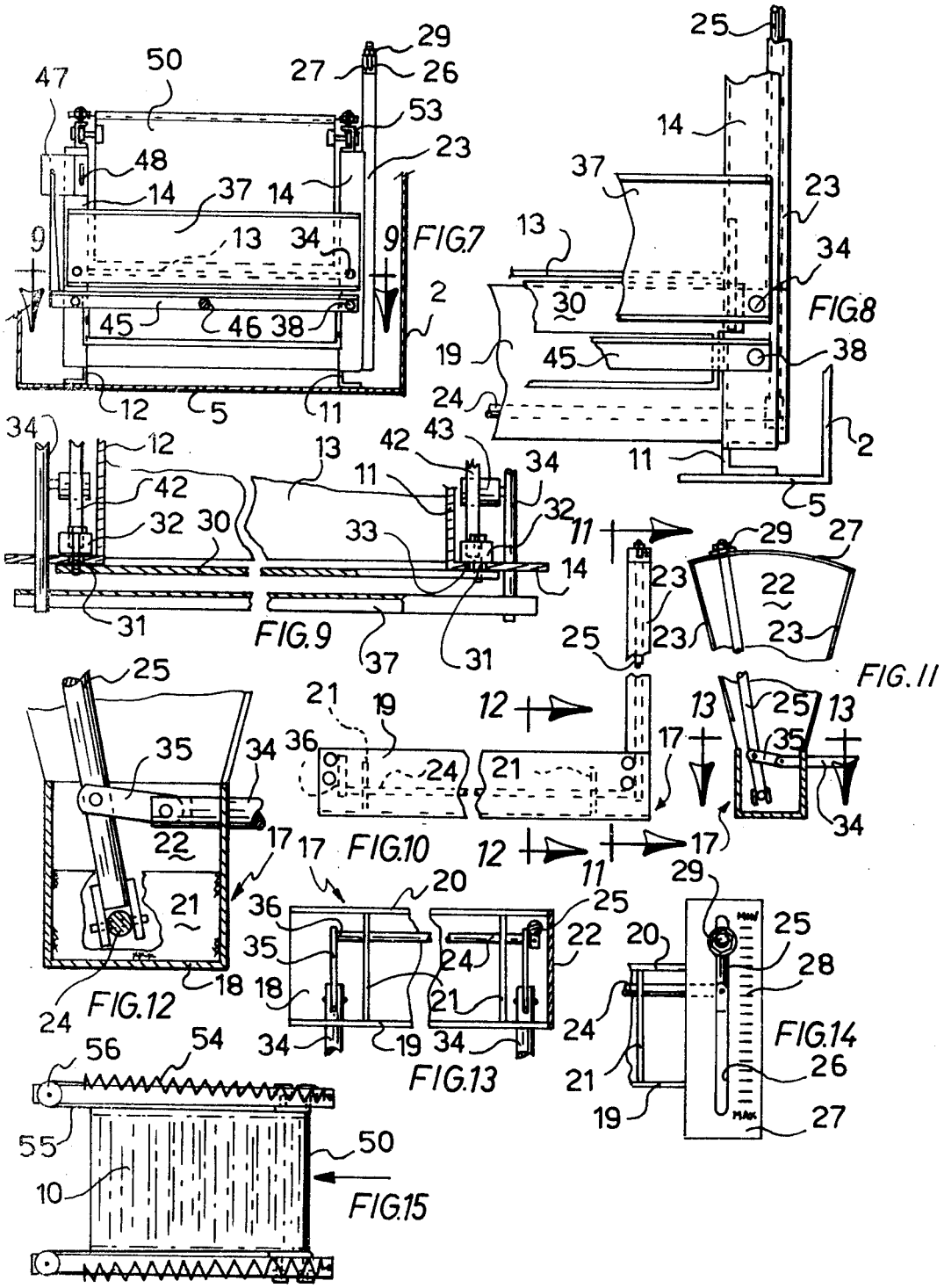

FIGS. 3*a* to 3*e* inclusive are schematic sequential views illustrating the dispensing of a newspaper;

FIGS. 4, 5, and 6 are enlarged and sequential views of a portion of FIG. 3 illustrating the dispensing of a newspaper;

FIG. 7 is a front view of the internal structure of the newspaper vending machine;

FIG. 8 is an enlarged partial view of FIG. 7;

FIG. 9 is a cross-sectional view as seen along line 9—9 in FIG. 7;

FIG. 10 is a front view of the carriage and the adjustment assembly carried thereby;

FIGS. 11 and 12 are cross-sectional views as seen along lines 11—11 and 12—12 respectively in FIG. 10;

FIG. 13 is a cross-sectional view as seen along line 13—13 in FIG. 11;

FIG. 14 is a top view of the adjustment assembly; and

FIG. 15 is a side view of a stack of newspapers and a rear abutment and biasing spring thereof.

The illustrated newspaper vending machine includes a housing having a front wall 1, side walls 2 and 3, a rear wall 4, a bottom 5 and a top 6. The above housing is carried by a base 7 having a downwardly and forwardly inclined front panel 8. A trough 9 is secured transversely against the front face of the front panel 8 and is arranged for falling of the dispensed newspaper thereon, as will be better explained later.

A support for a stack 10 of newspapers is mounted onto the bottom 5 of the above-mentioned housing and includes side panels 11 and 12 and a platform 13 secured transversely between the side panels. The support including the side panels 11 and 12 and the platform 13 is arranged to rest the newspapers edgewise thereon and transversely extending relative to the side panels 11 and 12. Each side panel 11 or 12 includes a flange 14 extending laterally outwardly at the front edge thereof. Each side panel 11 or 12 is cut to form an opening 15 therethrough and a pair of flanges 16 extending laterally outwardly along the front and rear edges respectively of the corresponding opening 15. The openings 15 of the two side panels 11 and 12 are transversely aligned and form a transverse space under the platform 13 into which is inserted a carriage 17 particularly illustrated in FIGS. 10 to 14 inclusive.

The carriage 17 includes a bottom 18, a front and a rear panels 19 and 20 and internal partitions 21 extending transversely between the front and rear panels 19 and 20 and rigidly secured to the latter. The end of the carriage 17 adjacent the side wall 2 is provided with an end panel 22 joined transversely to the front and rear panels 19 and 20 and forming a sector-shaped portion projecting upwardly above the latter. The sector-shaped portion of the end panel 22 is strengthened by transversely extending flanges 23.

A pivot axle 24 is pivotally supported by the partitions 21 into the carriage 17 and extends transversely relative to the stack 10 of newspapers. An adjustable lever arm 25 is rigidly secured at its lower end to the pivot axle 24 for rotation therewith and extends radially upwardly relative thereto. The upper end of the adjustable lever arm 25 projects upwardly through a slot 26 formed into an arc-shaped flange or plate 27 secured to the upper end of the abovementioned sector-shaped portion. Preferably, the arc-shaped flange or plate 27 is arranged coaxial to the pivot axis of the pivot axle 24 and is provided with markings 28 indicative of the range of newspaper thicknesses which is available and from which the actual thickness of the newspapers to be dispensed may be selected. The upper end of the lever arm 25 is threaded and a nut 29 is screwed onto that threaded end for tightening engagement against the upper face of the arc-shaped member 26. As will be better understood later, the pivot axle 24, the angularly adjustable lever arm 25, the arc-shaped flange or plate 27, and the tightening nut 29 form a newspaper thickness adjustment assembly arranged to readily set the vending machine for properly dispensing or delivering newspapers of one thickness or another such as to suit the thickness of any current edition.

A wedging plate or blade 30 is held by screws 31 against the front face of the laterally extending flanges 14. Each screw 31 also holds a block 32 against the rear face of the corresponding flange 14 and is upwardly displaceable along an upright slot 33 into the same flange 14. The wedging plate or blade 30 is therefore also supported for upward sliding movement and is adapted to engage into the stack 10 between the frontmost newspaper 10' and the remainder of the stack of newspapers.

One newspaper releasing or delivering rod 34 is slidably supported along the outer side of each side panel 11 and 12 by the corresponding frontmost flange 16 and the corresponding flange 14. The rear end of each rod 34 is pivotally secured by a link 35 to the lever arm 25 or to a shorter lever arm 36 at the other end of the pivot axle 24, as shown in FIGS. 10 and 13. A front abutment plate 37 is rigidly secured to the front end of the rods 34 and project upwardly thereof for abutment against the front end of the stack 10 of newspapers.

An actuating mechanism is provided to manually control the dispensing of a newspaper and includes a pair of actuating bars or rods 38 extending along the dispensing rods 34 respectively. Each actuating bar or rod 38 is slidably supported through aligned holes in the laterally extending flanges 14 and 16,16. The front and rear panels 19 and 20 are provided with aligned holes such that the actuating rods 38 extend therethrough and slidably support the carriage 17 for lengthwise displacement thereof relative to the stack 10.

A latch or hook 39 is pivoted onto the outside of each side panel 11 and 12 and is arranged to lock the carriage 17 into fully retracted position, that is with the rear panel 20 substantially engaging the rearmost flanges 17. The bottom face of each latch or hook 39 forms a cam surface arranged to be operatively engaged by a radial finger or projection 40 on the end of the corresponding actuating rod 38. The latter may be pivoted upwardly to release the carriage upon forward displacement of the actuating rod and of the radial fingers 40 thereof.

The above-mentioned actuating mechanism further includes an annular flange 41 rigidly secured to each actuating rod 38 for lengthwise displacement therewith intermediate the front and rear panels 19 and 20 of the carriage 17. A cam lever 42 is pivotally secured to each side panel 11 and 12 on the outside thereof and about an axis extending transversely relative to the stack 10. A roller 43 is rotatably secured to each actuating rod 38 on the inner side thereof and still about a transverse axis relative to the stack. Each roller 43 supports the corresponding cam lever 42, the free end of which is arranged to engage the corresponding block 32 and the bottom edge or face of which is suitably cammed to upwardly pivot the cam lever 42 and thereby upwardly displace the associated block 32 and the separating wedge plate or blade 30. A spring 44 is secured to each actuating rod 38 and the corresponding frontmost flange 16 to pull back the actuating rods 38 after forward sliding thereof. A tension spring 44' is secured to rear panel 20 of carriage 17, extends through an opening of rear flange 16 and is secured to side panel 11 or 12 to pull back carriage 17 to the position of FIG. 4.

A crossbar 45 rigidly secures together the two actuating rods 38 for bodily displacement thereof. A handle 46 projects forwardly of the front panel 1 and includes a stem portion extending through the front panel 1 and secured endwise to the crossbar 45 intermediate the ends thereof. A latch, not shown, of any suitable type, is operatively associated to the crossbar 45 and is arranged to lock the latter and the handle 46 into fully retracted inoperative position, as shown in FIG. 3. A coin-controlled device 47, of any suitable and known type, is secured as shown on the left in FIG. 7 and is connected to the above-mentioned latch to release the latter upon insertion of the right coinage into the coin slot 48. A cam return aperture 49 is provided through the front wall 1 of the machine and is operatively connected to the coin-controlled device 47, as is well known in the art of the vending machines.

A movable plate 50 forming a rear abutment for the stack 10, as shown in FIGS. 7 and 15, extends transversely of the stack and is biased to be forwardly displaced and to push the latter upon successive removals of newspapers from the front of the stack. The movable rear abutment plate 50 is rollably carried on each side of the stack 10 by rollers 51 engaged into a slot 52 of a track member 53, secured along the upper edge of the corresponding side panel 11 or 12. A biasing spring 54 is provided on each side of the stack 10 and is fixedly secured at the rear of the above-mentioned housing, extends forwardly and is attached to a cable 55 passing around a pulley 56 and secured at the rear to the rear newspaper abutment plate 50, thereby urging the latter forwardly.

FIGS. *3a* to *3e* inclusive are diagrammatic views merely illustrating the mode of operation of the wedging blade 30 and the front and the rear newspaper abutment plates. The afore-described front and rear newspaper abutment plates 37 and 50 are in these FIGS. *3a* to *3e* diagrammatically represented by members 37' and 50'.

In the inoperative position, as shown in FIGS. 3 and *3a*, the front abutment plate 37 or 37' holds the front end of the stack 10, the blade 30 is fully lowered and the handle 46, the actuating rods 38, the carriage 17 and the newspaper releasing rods 34 are fully retracted into their rearmost position.

When the appropriate coinage has been inserted into the slot 48, the crossbar 45, the actuating rods 38 and the handle 46 are released and allowed to be pulled forward. For the first state of forward displacement of the actuating rods 38, the hooks 39 hold the carriage 17 in its fully retracted inoperative position. During that first stage, the rollers 43 engage the cam surface of the corresponding cam levers 42, causing elevation of the blocks 32 and the blade 30 bodily therewith until the latter wedgingly engages between the frontmost newspaper 10' and the remainder of the stack 10 and such as to hold the remainder and to separate the frontmost newspaper therefrom, as shown in FIGS. *3b*, 4 and 5.

The second stage is reached when the fingers 40 release the corresponding hooks 39 and the radial flanges 41 engage the front panel 19 of the carriage 17. Until then, the front newspaper abutment panel 37 or 37' has remained in a predetermined position or spacing from the blade 30, as shown in FIG. 4. The above-mentioned predetermined spacing must be set to correspond to the width of the newspaper 10' to be dispensed. This setting is done by angularly adjusting the lever arm 25 about the pivot axis of the axle 24. The markings 28 and the nut 29 assist in readily changing the thickness setting. The markings 28 may, for instance, be calibrated to directly give the thicknesses to dispense using trained personnel or guessing. It may be seen that, when the lever arm 25 pivots forwardly, the front abutment plate 37 is also displaced forwardly and a thickner newspaper may then be dispensed. The above-mentioned spacing may therefore be set to accurately and reliably dispense only one newspaper at the time.

The second stage of the dispensing process consists in further pulling on the handle 46 until the carriage 17, the adjustment lever 25, the rods 34 and the plate 37 have sufficiently advanced to release the frontmost newspaper 10', as shown in FIGS. 3c and 6. The delivered newspaper 10' then falls between the rods 34, 38 and through a slot, not shown, in the bottom 5 of the housing to land into the trough 9 where the buyer gains access thereto.

Obviously, the above-described vending machine defines many details of construction which may be changed without departing from the spirit and scope of the invention as defined in the appended claims.

What I claim is:

1. In a newspaper vending machine, the combination comprising a support for carrying a stack of newspapers resting edgewise thereon, a first and a second movable abutment means arranged to engage the opposite ends of said stack respectively, a separating wedge means displaceable edgewise upwardly into separating position between the one newspaper against said first movable abutment means and the remainder of said stack, an actuating mechanism operatively connected to said separating wedge means and constructed and arranged to displace the latter into said separating position, a handle connected to said actuating mechanism and arranged to actuate the latter and said separating wedge means, and link means connected to said actuating mechanism and to said first movable abutment means and arranged to increase the spacing of the latter from said separating wedge means and to release said one newspaper for access thereto and wherein said actuating mechanism includes a pair of actuating links extending along opposite sides of said stack respectively and rigidly secured to said handle for displacement therewith lengthwise of said stack, a pair of cam levers pivoted about a transverse axis relative to said stack and arranged on opposite sides of the latter respectively, to upwardly engage and displace said wedge means upon operative actuation thereof, and said actuating links are constructed and arranged to engage said cam levers and to operatively pivot the same.

2. A newspaper vending machine as defined in claim 1, further including an adjustment means connected to said link means and constructed and arranged to selectively set the latter and adjust the spacing between said first movable abutment means and said separating wedge means proportionally to the thickness of the newspaper to be dispensed by the machine.

3. A newspaper vending machine as defined in claim 2, wherein said adjustment means includes a carriage displaceably mounted for to and fro movement lengthwise of said stack, an adjustment member mounted onto said carriage and arranged for displacement relative thereto lengthwise of said stack, said link means are connected to said adjustment member and to said first movable abutment means and arranged to adjustably vary the spacing of the latter from said wedge means in response to displacement of said adjustment member relative to said carriage.

4. A newspaper vending machine as defined in claim 3, wherein said adjustment member includes an adjustable lever pivotally mounted onto said carriage alongside said stack about a pivot axis extending transversely of the latter, and angular setting means are mounted onto said carriage and constructed and arranged to angularly adjust said adjustable lever about said transverse pivot axis.

5. A newspaper vending machine as defined in claim 4, wherein said angular setting means includes an arc-shaped member secured to said carriage for displacement therewith and having a slot therethrough extending lengthwise of said stack and arranged for angular displacement of said adjustable lever therein, said adjustable lever includes a rod pivoted at one end about said pivot axis and having a free threaded end projecting through said slot of said arc-shaped member, and a nut is screwed onto said free threaded end and arranged to adjustably tighten said rod into different position along said arc-shaped member and about said pivot axis.

6. A newspaper vending machine as defined in claim 3, wherein said actuating links constitute actuating rods, a crossbar rigidly joins said actuating rods for bodily displacement thereof, and a roller is rotatably secured to each of said actuating rods and supports the corresponding cam lever to cause upward pivoting of said levers upon lengthwise displacement of said handle.

7. A newspaper vending machine as defined in claim 1, further comprising upright members secured to said support and having a pair of parallel upright slots extending therethrough, said separating wedge means constituting a blade, blocks bolted to said blade through said slots and arranged on opposite side of said upright members relative to said blade and to be engaged by said cam levers for upward sliding of said blade upon operative actuation of said cam levers.

8. A newspaper vending machine as defined in claim 6, wherein said actuating rods slidably extend through said carriage and include each a radial projection fastened thereto and arranged to engage said carriage and displace the latter towards said one newspaper jointly with said newspaper delivering rods and said first movable abutment means.

9. A newspaper vending machine as defined in claim 8, further including springs connected to said actuating rods and arranged to bias the latter into retracted position in the direction from said first towards said second movable abutment means, the latter including an upright plate resting against the other end of said stack, springs engaging said upright plate and urging the latter into engagement with said other end of said stack, hooks pivoted relative to said support adjacent said actuating rods respectively and arranged to releasably hold said carriage in retracted position towards said other end of said stack, an actuating finger secured to each of said actuating rods and arranged to operatively engage and release a corresponding one of said hooks and to thereby allow displacement of said carriage towards said one end of the stack of newspapers, a housing into which are mounted said support, said first and second movable abutment means, said blade, said actuating rods and said newspaper delivering rods, said housing having a front face extending transversely outwardly of said one end of said stack, and having an aperture and a newspaper dispensing outlet therethrough underlying said stack, said handle projecting outwardly of said housing through said aperture, and a coin-controlled unit secured to said front face and constructed and arranged to releasably hold said handle against operation until suitable coinage has been inserted into said coin-controlled unit.

* * * * *